US008966846B1

(12) United States Patent
Sisk

(10) Patent No.: US 8,966,846 B1
(45) **Date of Patent: *Mar. 3, 2015**

(54) STEEL ANCHORED REINFORCED MINE SEAL

(71) Applicant: Frank A. Sisk, Equality, IL (US)

(72) Inventor: Frank A. Sisk, Equality, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/915,084

(22) Filed: Jun. 11, 2013

Related U.S. Application Data

(63) Continuation of application No. 11/773,096, filed on Jul. 3, 2007, now Pat. No. 8,485,873.

(51) Int. Cl.
*E04B 1/18* (2006.01)
*E21F 1/14* (2006.01)

(52) U.S. Cl.
CPC ..... *E21F 1/14* (2013.01)
USPC ..... 52/414; 52/854; 454/169

(58) Field of Classification Search
CPC ..... E04B 5/38; E04B 1/161; E04C 2/044
USPC ..... 52/344, 414, 854; 454/169
See application file for complete search history.

(56) References Cited

U.S. PATENT DOCUMENTS

| | | | | |
|---|---|---|---|---|
| 4,096,702 | A | 6/1978 | Burton | |
| 4,247,221 | A | 1/1981 | Lewer et al. | |
| 4,500,763 | A | 2/1985 | Schmidt et al. | |
| 4,621,951 | A | 11/1986 | Dewson | |
| 5,287,672 | A | 2/1994 | Moore | |
| 5,401,120 | A * | 3/1995 | Hussey et al. | 405/132 |
| 5,466,187 | A | 11/1995 | Kennedy et al. | |
| 5,647,110 | A | 7/1997 | Ritter et al. | |
| 5,879,231 | A | 3/1999 | Sisk | |
| 6,178,710 | B1 * | 1/2001 | Colalillo | 52/310 |
| 6,272,805 | B1 | 8/2001 | Ritter et al. | |
| 6,450,735 | B1 | 9/2002 | Mills et al. | |
| 6,705,055 | B2 * | 3/2004 | Ritter et al. | 52/309.11 |
| 8,485,873 | B2 * | 7/2013 | Sisk | 454/169 |

FOREIGN PATENT DOCUMENTS

| | | |
|---|---|---|
| ZA | 846984 | 8/1984 |

OTHER PUBLICATIONS

Correspondence about and technical specifications of a 24-Hour Mine Seal that passed an explosion test at NIOSH's Lake Lynn Experimental Mine in Oct. 2002.

Art Sanda, PMR Builds a Better Mouse Trap, But No Path Beating to the Door, Coal People Magazine, Oct./Nov. 2007, vol. 30 No. 3, pp. 17-23.

(Continued)

*Primary Examiner* — John K Fristoe, Jr.
*Assistant Examiner* — Angelisa Hicks
(74) *Attorney, Agent, or Firm* — Grace J. Fishel

(57) ABSTRACT

A reinforced mine ventilation seal anchored with steel dowels into the strata of a mine passageway. The seal has a pair of metal mats formed of vertical and horizontal elongated reinforcing members that are sandwiched between a row of dowels set into the floor and ceiling of the passageway and extending into the passageway. The metal mats and the dowels are encased in a structural material such as concrete to form a seal which is capable of bidirectionally withstanding an overpressure due to an explosion. The dowels provide shear reinforcement and the metal mats provide flexural strength.

10 Claims, 7 Drawing Sheets

(56) References Cited

OTHER PUBLICATIONS

W. Randolph Williams, Mine Mapping and Layout, copyright 1983, pp. 395-397.
Robert J. Timko and Edward D. Thimons, Techniques for Constructing Concrete Block Stoppings, United States Department of the Interior, 1983, pp. 1-5, Figures 1-24.
Mine Safety & Health Administration Approval & Certification Center, List of Suitable Sealants for Mine Ventilation Controls (Stoppings & Overcasts), last updated Nov. 23, 2010.
Eric S. Weiss, Kenneth L. Cashdollar, I. Verne S. Mutton, Deepak R. Kohli and William A. Slivensky, Niosh RI 9647 Evaluation of Reinforced Cementitious Seals, Aug. 1999.
Thomas D. Pruitt, letter to Insteel Construction Systems, Inc., May 11, 1990R.
Thomas D. Pruitt, letter to Insteel Construction Systems, Inc., Oct. 6, 1989.
Robert N. Hoffman, Homeless, Not Hopeless, the Do-It Yourself Home Improvement and Woodworking Magazine, Nov. 1991, p. 34-37.
EVG 3-D Approvals & Certifications before 1997 (part 2).
EVG 3-D Approvals & Certifications before 1997.
EVG 3D—Construction System Brochure, circa 1993.
EVG 3D—Construction System Brochure, English and Vietnamese, 1993.
Final Report of Testing Services LAW Engineering, Aug. 23, 1990.
Final Results on 3D Concrete Panel Testing LAW Engineering, Jun. 23, 1995.
ICC Evaluation Servicee, Inc., Mar. 1, 2006 with drawings created before Nov. 1996 Service.
Insteel 3-D Pamphlet published 1992-1993.
National Evaluation Service, Inc. Report 1995.
Structural Engineering Handbook, Structural Analysis of ICS 3-D Wall Panels, Feb. 1991r.
Test Report on Slender Walls Using Insteel 3Cast, Jun. 1, 1996.
Nancy L. Ross, In the Eye of the Storm, The Washington Post, Sep. 10, 1992.
The Principles and Practice of Mine Ventilation, 1951.
Bureau of Mines Report, RI 8491, Constructing Ventilation Bulkheads With Shotcrete Wire Panel, 1983.

* cited by examiner

STEEL ANCHORED REINFORCED MINE SEAL

BACKGROUND OF THE INVENTION

1. Field of the Invention

The present invention relates to a reinforced seal cast from a structural material and anchored with steel dowels into the floor and ceiling of a mine passageway. The seal is capable of bidirectionally withstanding an overpressure substantially greater than 20 psi.

2. Brief Description of the Prior Art

Seals are required in U.S. mine ventilation plans to protect against explosions and are used extensively in mining to isolate worked-out areas. Over the years, tens of thousands of seals have been erected in underground coal mines in the United States. In the 1990s there were a number of explosions of methane and/or coal dust within sealed areas of underground U.S. coal mines. These explosions, believed to be initiated by lightning strikes on the surface, destroyed numerous seals and did considerable damage in the active workings.

A response to the above-mentioned disasters was to require that abandoned areas of a mine must be either ventilated or isolated from active workings through the use of seals capable of withstanding a static horizontal pressure of 20 psi. More recently, in response to other mine disasters with fatalities, the standard for mine seals has been substantially increased to require seals to withstand static horizontal pressures of 50 psi or even 120 psi in some instances.

Prior art mine seals formed from masonry or concrete are not designed to meet such blast criteria even when hitched into the passageway with roof bolts or grooves into the ribs. There is a need, therefore, for a cost effective and efficient way to construct a mine seal meeting the higher standards for explosion resistance.

BRIEF SUMMARY OF THE INVENTION

In view of the above, it is an object of the present invention to provide a mine ventilation seal meeting current blast criteria. It is another object to provide a mine ventilation seal that is capable of bidirectionally withstanding overpressures substantially greater than 20 psi, e.g., 50 psi and 120 psi. It is also an object to provide a mine ventilation seal having the above-mentioned characteristics that can be built in a cost effective and efficient way. Other objects and features of the invention will be in part apparent and in part pointed out.

In accordance with the present invention, a reinforced slab is anchored with steel dowels into the strata of a mine passageway. The reinforced slab has a pair of spaced apart metal mats formed of vertical and horizontal reinforcing members which are sandwiched between a row of dowels set into the floor and ceiling of the mine passageway and extend into the passageway. A structural material encapsulates the metal mats and dowels to form a plug which has enhanced shear and flexural strength.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
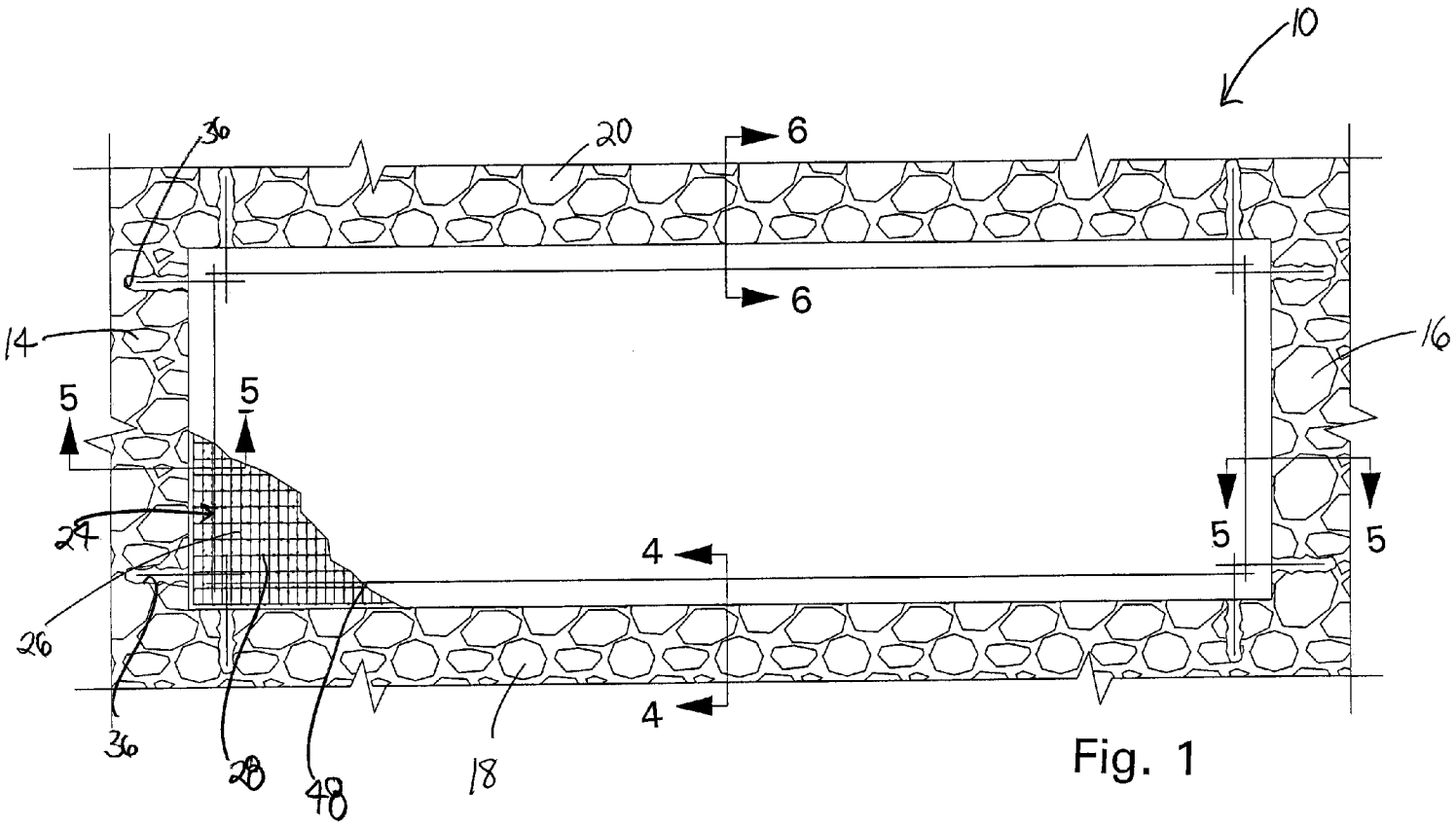
FIG. 1 is a side elevation of a mine ventilation seal in accordance with the present invention with part of the structural filling material broken away to show internal details.
Figure 2:
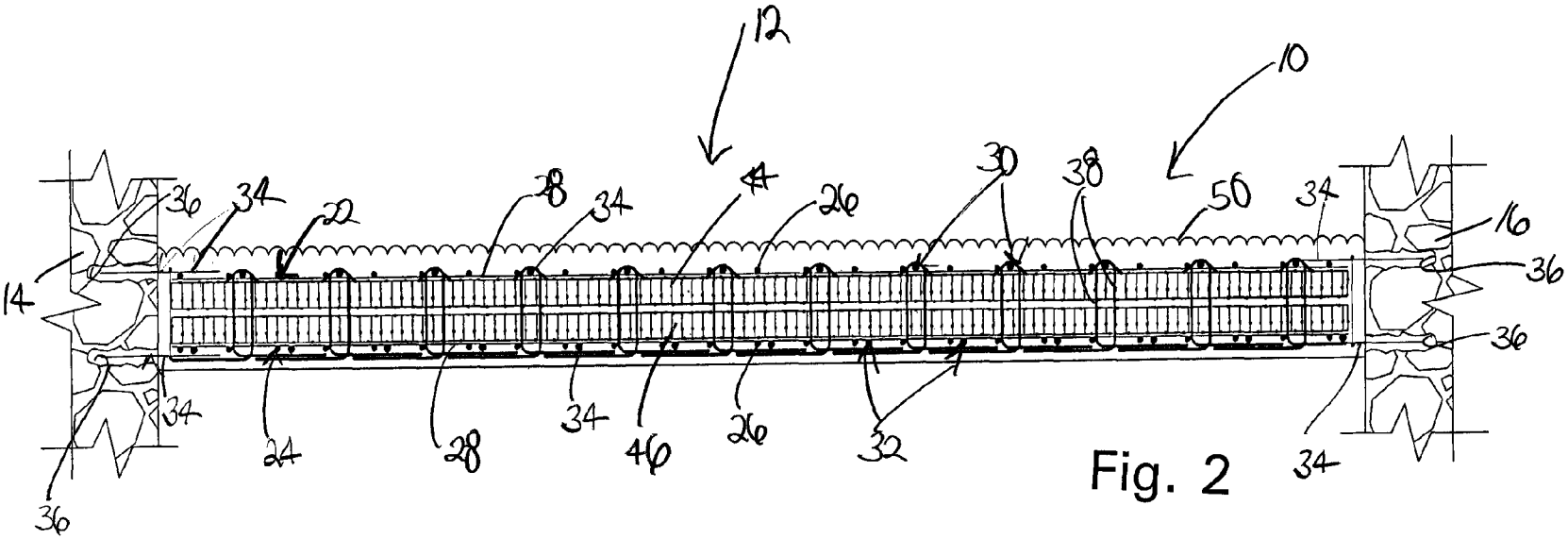
FIG. 2 is a plan view of the mine ventilation seal.
Figure 3:
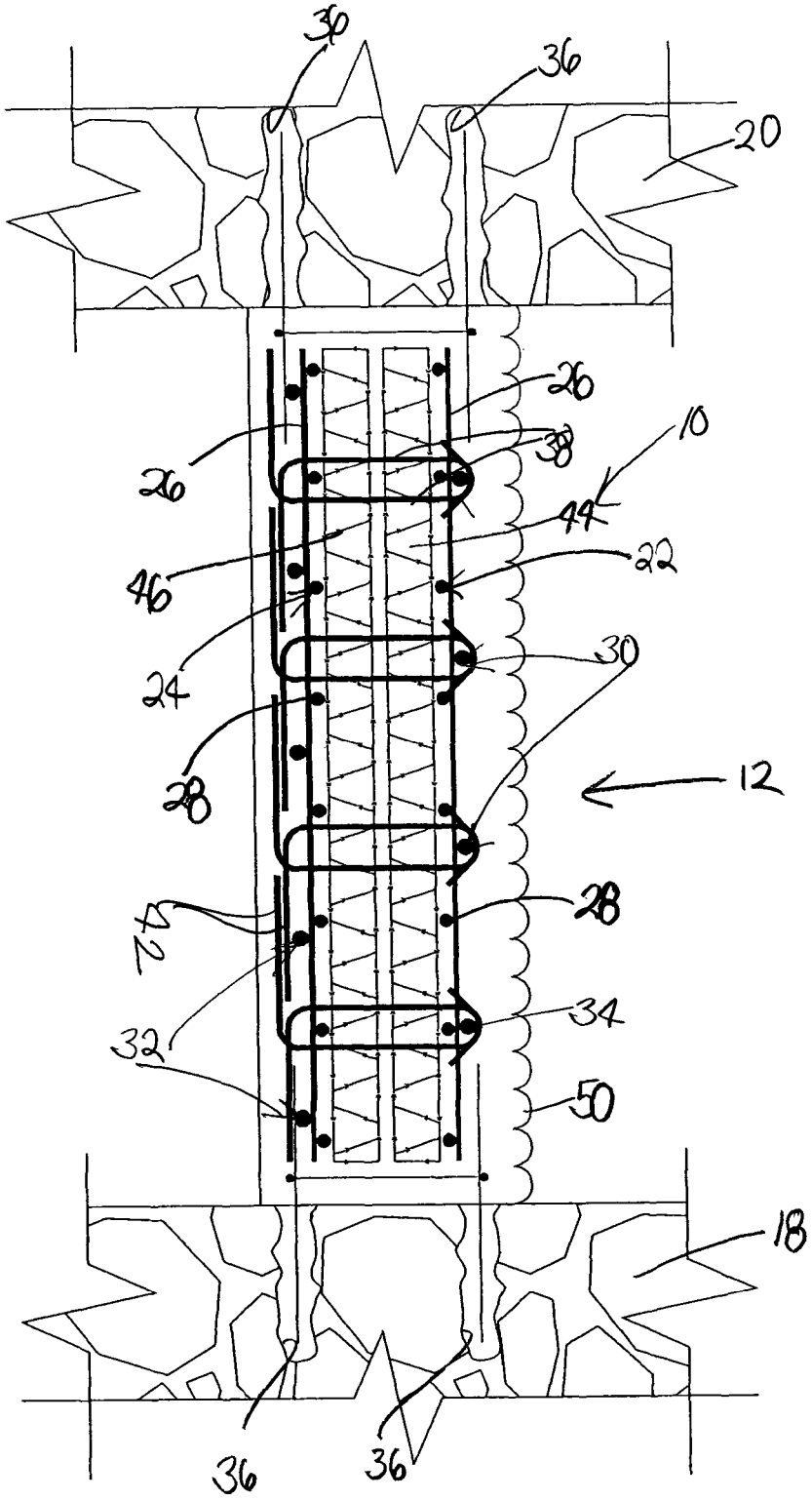
FIG. 3 a side view of the mine ventilation seal adjacent a rib of the mine passageway.
Figure 4:
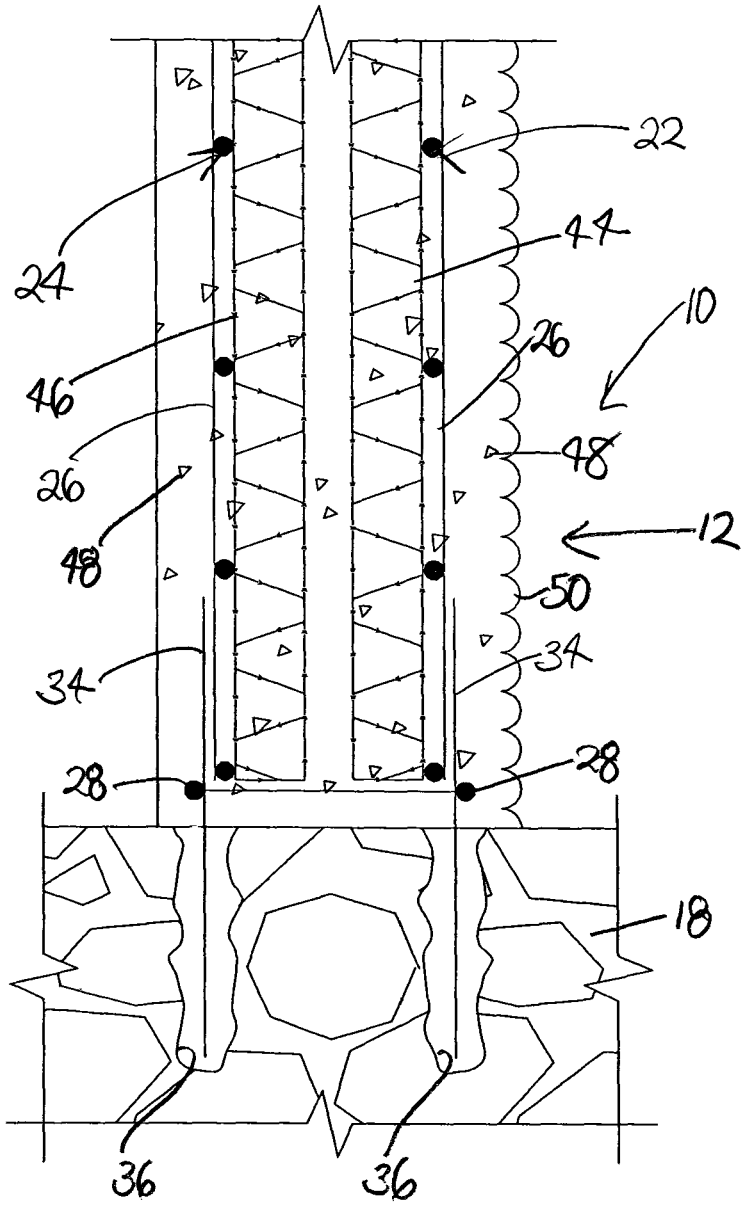
FIG. 4 is a section taken along the plane of 4-4 in FIG. 1.
Figure 5:
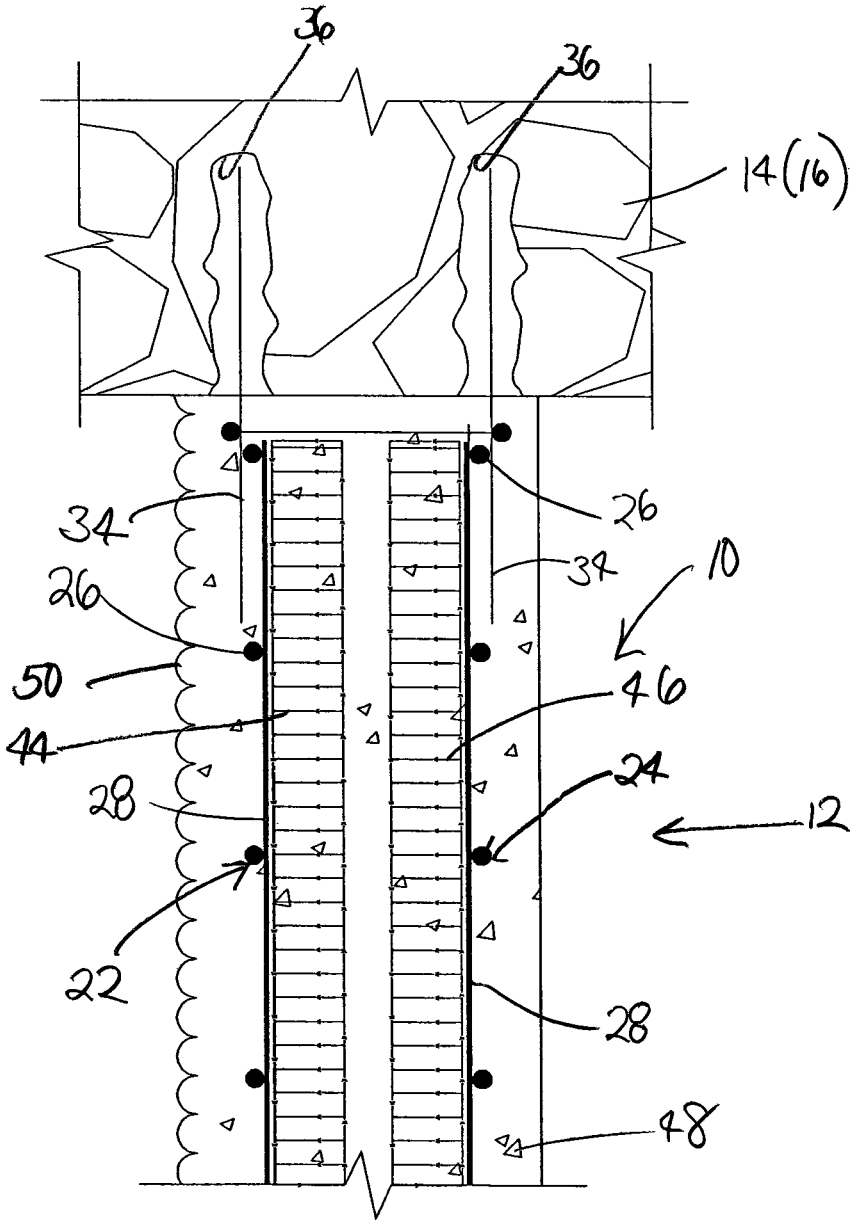
FIG. 5 is a section taken along the planes of 5-5 in FIG. 1.
Figure 6:
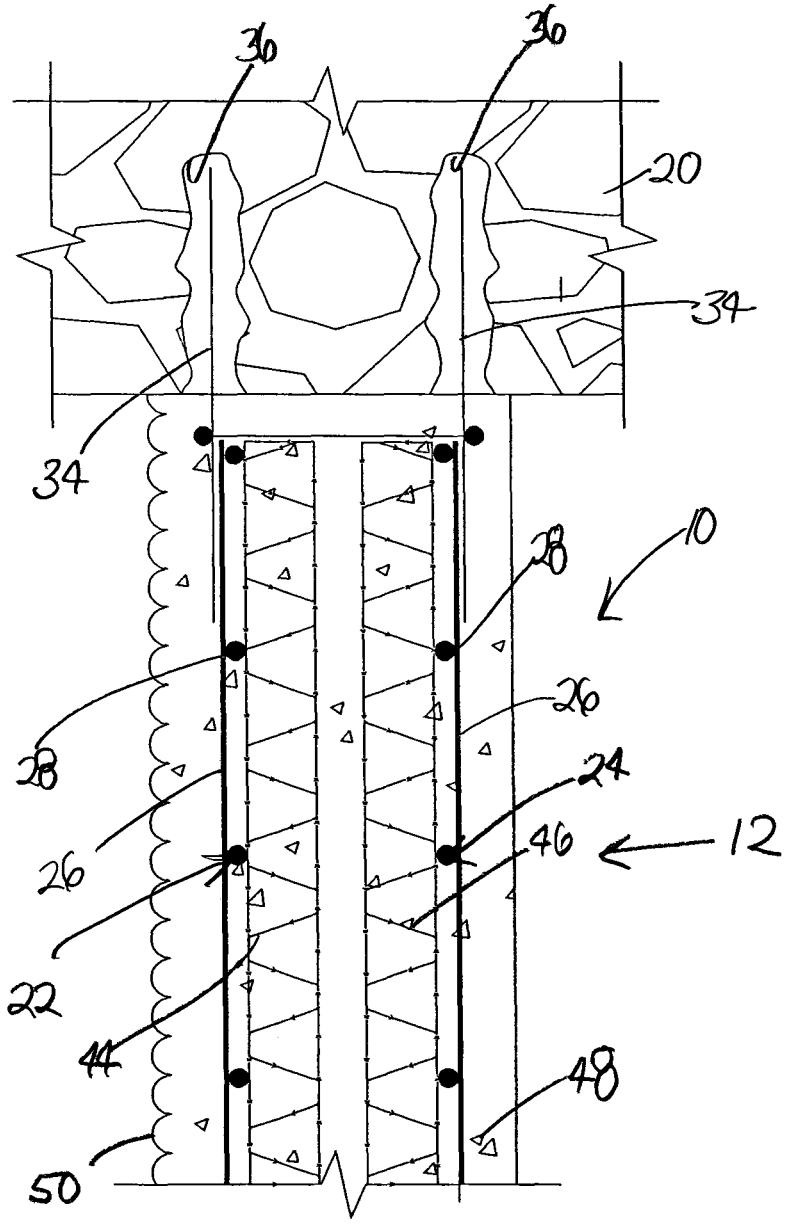
FIG. 6 is a section taken along the plane 6-6 in FIG. 1.

Referring to the drawings more particularly by reference character, a steel anchored reinforced mine seal 10 in accordance with the present invention is shown in a mine passageway 12 with first and second side walls or ribs 14, 16, a floor 18 and a ceiling 20. Mine seal 10 is formed around a metal structure including first and second metal mats 22, 24, respectively. Each of metal mats 22, 24 is composed of vertical and horizontal elongated reinforcing members 26, 28, respectively, laid at right angles to each other. Horizontal reinforcing members 28 extend transverse of passageway 12 and vertical members 26 extend heightwise of passageway 12. Metal mats 22, 24 provide flexural strength to seal 10 and are spaced apart longitudinally of passageway 12 in vertical parallel relationship with horizontal members 28 positioned inboard of vertical members 26.

Reinforcing members 26, 28 may be formed as elongated rods or bars and can have any suitable cross-section, for example round, square, or rectangular. When rebar is used for reinforcing members 26, 28, the gauge and grade will depend upon on the flexural strength needed to withstand the overpressure for which seal 10 is designed. For example, when seal 10 is designed to withstand an overpressure of 50 psi from a mine explosion with a maximum seal height of 8 feet and a maximum seal width of 21 feet, vertical members 26 may be #7 rebar, grade 60 on 10 inch centers, and horizontal members 28 may be #5 rebar, grade 60, on 12 inch centers (e.g., MSHA approved 50 psi seal of Precision Mine Repair). If seal 10 is designed to withstand an overpressure of 120 psi, vertical members 26 may be #9 rebar, grade 60, on 12 inch centers, and horizontal members 28 may be #5 rebar, grade 60, on 12 inch centers (e.g., MSHA approved 120 psi seal of Precision Mine Repair). From the above, it will be clear to those skilled in the art that the choice of material for reinforcing members 26, 28 (e.g., size and grade) and the spacing between the members is not limited to the above-mentioned examples which are provided by way of example, not limitation. The choice, however, is subject to engineering analyses and MSHA approval.

Endmost vertical members 26 should be spaced a distance from ribs 14, 16 to allow filling material which is more particularly discussed below to flow around the bars. For like reason topmost horizontal members 28 should be spaced a distance from ceiling 20. If vertical or horizontal members 26, 28 are spliced, the members may be wire tied or mechanical coupled with couplers.

The metal structure also includes first and second rows 30, 32 of dowels 34 seated in holes 36 drilled into floor 18 and ceiling 20 of passageway 12. Inby and outby rows of dowels 34 may also be set into side walls 14, 16. The spacing between dowels 34 in first and second rows 30, 32 should not be less than one dowel diameter and in most instances is far greater.

In PMR's 50 psi seal approved by MSHA mentioned above, dowels 34 are formed of #8 rebar, grade 60, and placed on 10 inch centers. Holes 36 in floor 18 and ceiling 20 may be aligned vertically with a string line and plumb bob, or equivalent, to assure that the ceiling and floor dowels 34 in each row are aligned vertically. Dowels 34 may also be staggered between rows such that dowels 34 in first and second rows 30, 32 are not aligned longitudinally of passageway 12. In PMR's approved 120 psi seal 10 no dowels are provided in side walls 14, 16 and dowels 34 in floor 18 and ceiling 20 are formed of #9 rebar, grade 60, and set on 14 inch centers.

Rows 30, 32 of dowels 34 provide bidirectional shear reinforcement bracing seal 10 against lateral movement in passageway 12. Dowels 34 may be set to a depth and grouted into the strata of passageway 12 such that the pull strength is equal to the full tensile yield strength of the dowel. The depth necessary to develop this pull strength in a particular strata must be determined empirically based on pull-out tests conducted in ceiling and floor strata representative of the seal location. Dowels 34 extend a distance into passageway 12 such that they overlap one or more of horizontal members 28 of metal mats 22, 24. For example, when dowels 34 are set into the strata 2 to 2½ feet, dowels 34 may extend into passageway 12 a distance of 2 feet or more. When vertical members 26 align with dowels 34, vertical members 26 may be wire tied or mechanically coupled to dowels 34. In like manner horizontal members 28 may be wire tied to coupled to dowels 34 in side walls 14, 16 and the horizontal members align with the dowels.

Figure 7A:
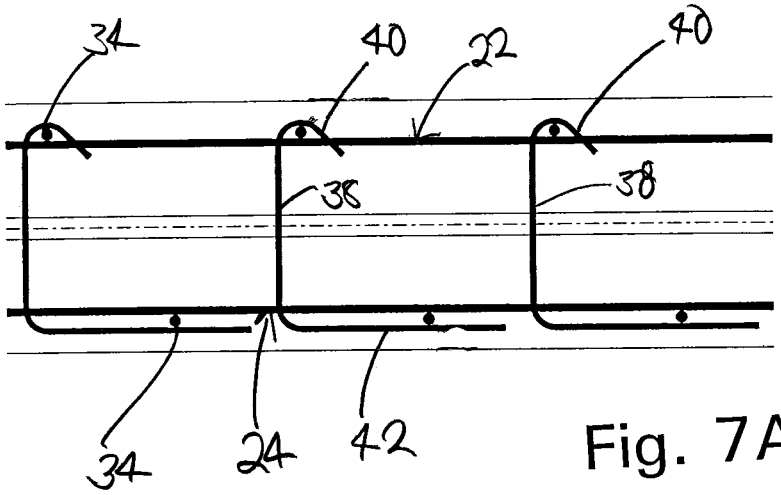
FIG. 7A is a detail showing inby and outby dowels laced together with a stirrup; and, FIG. 7B is a detail showing inby and outby dowels laced together with a pair of stirrups.
Figure 7B:
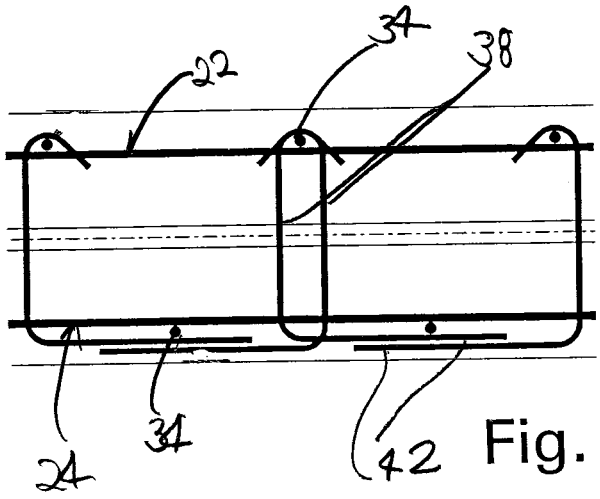

Seal shear and flexural strength of seal 10 may be further improved by lacing dowels 34 together with stirrups 38 as shown in FIGS. 7A and 7B. As illustrated, one end 40 of stirrup 38 is hooked around a dowel 34 on the inby side of seal 10 while a straight leg 42 overlies a dowel 34 on the outby side of seal 10. In FIG. 7A, one stirrup 38 is used to lace together the dowels on the inby and outby sides, whereas two stirrups 38 are used in FIG. 7B. Stirrups 38 may be formed of the same kind of materials used for the other elements of metal structure or of smaller gauge, for example #4 rebar, 60 grade.

The space between metal mats 22, 24 may be open to be filled with concrete or supplied with additional reinforcement such as a pair of 3-D building panels 44, 46, sections of which are arranged in side-by-side relationship, as described in PMR's U.S. Pat. No. 5,879,231 which is incorporated by reference herein. Panels 44, 46 add to the flexural strength of seal 10. As described in PMR's earlier patent, each panel is formed of a pair of wire grids interconnected by strut wires which pass through a core of insulation and form a truss system. For use in seal 10, the core of insulation is dissolved away for reasons which will become apparent.

As shown in the drawings, an air sampling tube (not shown) and a water drain (not shown) may also be provided in seal 10. The drain should be equipped to prevent the exchange of air through the pipe.

A filling of structural material 48 (shown in FIGS. 1 and 4-6) is applied to metal structure integrating the metal structure into a reinforced slab which is anchored into the strata of passageway 12 with dowels 34. Structural material 48 may be normal concrete, high strength concrete, light weight concrete, concrete with special cements and aggregates, polymer modified concrete, special cement mortar, special polymer mortar and other commercially available materials that are sufficient strong when hardened.

In seal 10 as shown in the drawings, structural material 48 is applied in the form of gunite or shotcrete. In which case a sheet metal wall 50 is built on the inby side of seal 10 several inches away from dowels 34 as a backstop for the gunite. Wall 50 should be adequately braced against vibration and may be vented to permit escape of air during the gunning operation. Multiple layers of gunite or shotcrete are applied until metal structure is embedded to a depth of several inches. To ensure complete encasement of metal structure, the gunite or shotcrete should be applied with sufficient velocity and plasticity so that the structural material flows around and behind metal structure and overlaps side walls 14, 16, floor 18 and ceiling 20 forming an airtight seal. Layers of shotcrete should be allowed to take an initial, soft set before succeeding layers are applied. If seal 10 is not placed monolithically (i.e., placement of shotcrete layers are interrupted), a bonding agent may be applied to and worked into the fully set concrete prior to additional shotcrete placement.

Structural material 48 may also be poured in layers around metal structure. In which case a reusable metal form such as described in U.S. Pat. No. 6,220,785 to Kennedy et al., dry stacked or mortar set cinder blocks or the like may be used. Depending on the nature of the form, the form may be a permanent part of seal 10 or removed after structural material 48 has set. When structural material is poured, a gap may be left along ceiling 20 which may be grouted closed to provide an airtight seal.

In use, seal 10 as shown in the drawings is designed to be placed in an area with competent ceiling 20 and floor 18 and is applicable to a wide range of mine geologic formations. Seal 10 should be located at least 10 feet away from the corner of any pillar and may be constructed as follows:

1) The area in passageway 12 to be sealed should be cleaned of all loose material on ceiling 20, ribs 14, 16 and mine floor 18 for a distance of several feet on each side of the seal. This may be accomplished with a high pressure air hose. Should weak conditions persist, ribs 14, 16 may be reinforced by bolting or grouting.

2) A vented or no-vented metal wall 50 is installed in the seal opening.

3) Inby dowels 34 are drilled and glued to the depth of the mine seal plan along ceiling 20 and floor 18. If dowels 34 are provided in side walls 14, 16, the inby dowels 34 along side walls 14, 16 are also drilled and glued.

4) Vertical members 26 of inby metal mat 22 are installed on centers to plan from rib 14 to rib 16. Couplers or wire ties may be used to join vertical members 26 to inby dowels 34 where they line up.

5) Inby horizontal members 28 are installed on centers to plan from ceiling 20 to floor 18. If dowels 34 are provided in ribs 14, 16, horizontal members 28 may be coupled to the dowels or wire tied where they line up.

6) Two 3-D panels 44, 46 are placed next to inby metal mat 22 with space left on the rib sides as well as the ceiling for the installation of stirrups 38.

7) Outby dowels 34 are drilled and glued to the depth of the mine seal plan along ceiling 20 and floor 28 and along ribs 14, 16, if provided.

8) Horizontal members 28 of outby metal mat 24 are installed from ceiling 20 to floor 18.

9) Outby vertical members 26 are installed from rib 14 to rib 16.

10) Stirrups 38 are installed lacing inby and outby dowels 34 along ceiling and floor together and lacing inby and outby dowels along ribs 14, 16, if provided.

11) Gunite is then applied to the metal structure which includes metal mats 22, 24, 30-D panels 44, 46 and inby and outby rows 30, 32 of dowels 34 to a depth of 2 inches of gunite over dowels 34 on each side such that metal mats 22, 24 are embedded to a depth of about 3 inches. During application, the material and the surrounding air temperature should be maintained at a minimum of 50 degrees F. and thereafter for 7 days after the completion of the work. Rebound material should not be salvaged and reused.

12) In some instances, MSHA approval may require a supplemental roof support (not shown) on both the outby and inby side of seal 10 as by cribbing or the equivalent.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A reinforced mine ventilation seal for a passageway in a mine, said seal capable of bidirectionally withstanding overpressures at least 50 to 120 psi comprising, a metal structure having first and second metal mats of vertical and horizontal rebar members extending transversely of the passageway between the ribs and heightwise of the passageway between the floor and ceiling, said metal mats spaced apart longitudinally of the passageway in vertical parallel relationship, and first and second rows of spaced apart steel dowels seated in vertically aligned holes drilled into the floor and the ceiling of the passageway and extending into the passageway, said first and second rows of spaced apart steel dowels respectively coupled to the vertical members in the first and second mats forming a sandwich; and, a filling of structural material embedding the metal mats and the dowels, whereby said dowels provide bidirectional shear reinforcement bracing the seal against lateral movement in the passageway and said metal mats provide flexural strength.

2. The mine ventilation seal of claim 1 wherein the first and second rows of dowels are laced together by stirrups.

3. The mine ventilation seal of claim 1 wherein the first and second rows of dowels extend along the ribs and are seated in horizontally aligned holes drilled into the ribs.

4. The mine ventilation seal of claim 1 wherein the dowels in the first and second rows are offset longitudinally of the passageway.

5. The mine ventilation seal of claim 1 wherein a first and second row of 3-D panel sections with an insulated core removed are sandwiched between the first and second metal mats.

6. The mine ventilation seal of claim 1 wherein the metal structure is embedded in the filling material to a depth of several inches on an inby and outby side of the seal.

7. The mine ventilation seal of claim 1 wherein the horizontal rebar members are positioned inboard of the vertical rebar members in the first and second metal mats.

8. The mine ventilation seal of claim 1 wherein some of the vertical and horizontal rebar members are spliced together with wire ties or mechanically coupled with couplers.

9. The mine ventilation seal of claim 1 wherein the steel dowels in the first and second rows are grouted into the holes such that the pull strength on the dowels is substantially equal to the tensile yield strength of the dowels.

10. The mine ventilation seal of claim 1 wherein a water drain or an air sampling tube is provided in the seal.

* * * * *